US007802375B2

(12) United States Patent
Johnson

(10) Patent No.: US 7,802,375 B2
(45) Date of Patent: Sep. 28, 2010

(54) CLOTHES DRYER LINT SCREEN ASSEMBLY WITH BUILT IN LINT SCRAPER BLADE

(76) Inventor: Michael Johnson, 1331 Davis Ave., Birmingham, MI (US) 48009

( * ) Notice: Subject to any disclaimer, the term of this patent is extended or adjusted under 35 U.S.C. 154(b) by 868 days.

(21) Appl. No.: 11/381,759

(22) Filed: May 5, 2006

(65) Prior Publication Data

US 2007/0256317 A1 Nov. 8, 2007

(51) Int. Cl.
*F26B 21/06* (2006.01)

(52) U.S. Cl. ..... 34/82; 34/85

(58) Field of Classification Search ..... 210/407, 210/408, 409, 413, 159; 209/379, 385, 386, 209/387, 388; 34/82, 85, 604, 595, 235
See application file for complete search history.

(56) References Cited

U.S. PATENT DOCUMENTS 1,959,491 A * 5/1934 Moran ..... 210/413
2,612,705 A 10/1952 Kauffman, II
4,653,200 A 3/1987 Werner
4,720,925 A 1/1988 Czech et al.
5,651,188 A 7/1997 Swanson et al.
6,016,610 A 1/2000 Sears

* cited by examiner

*Primary Examiner*—Kenneth B Rinehart
(74) *Attorney, Agent, or Firm*—John R. Benefiel

(57) ABSTRACT

A lint screen assembly for a clothes dryer has a scraper blade within an open frame which mounts a lint screen panel to enable scraping out accumulated lint therefrom. The scraper blade is pivotable from a stowed position to an on-edge operative position and guided when being stroked across the lint screen panels by pivot pins captured in slots in opposite side members of the open frame.

6 Claims, 4 Drawing Sheets

CLOTHES DRYER LINT SCREEN ASSEMBLY WITH BUILT IN LINT SCRAPER BLADE

BACKGROUND OF THE INVENTION

This invention concerns clothes dryers and more particularly lint screens for such dryers.

It is conventional practice to circulate heated air in the dryer through a screen to collect lint from the clothes which is generated during the drying cycle.

The lint accumulates on the screen and must be periodically removed to prevent obstruction of the air flow which would interfere with proper dryer operation.

Removal is conventionally done with the fingers, but this is not particularly effective and allows lint to be scattered as well as being a messy/dirty chore.

It is the object of the present invention to provide a lint screen which incorporates a built-in scrapper which eliminates the need for direct handling of the collected lint, and reduces the tendency for scattering of the collected lint.

SUMMARY OF THE INVENTION

The above recited object as well as other objects which will become apparent upon a reading of the following claims are achieved by a removable lint screen assembly which includes a scraper blade mounted to an open lint shield frame to be self stored thereon, extending across a lint screen panel held in the frame. In a stowed retracted position, the blade lies flat against the screen itself at the top of the lint screen frame, with a handle portion recessed into a grip on the lint screen frame.

The scraper blade has pivots at each end to allow the handle to be swung out which orients the blade edge to be directed against a lint screen panel held in the frame. The pivots are received in respective slots in respective frame side members, allowing a user to stroke the blade down the lint screen panel to scrape the lint from the screen while holding the screen over a waste basket or trash bag for convenient disposal of the collected lint.

A return spring on each end of the scrapper retracts the shield back to a return position and another pair of springs on the pivots urges the scraper blade to rotate back to its stowed position.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
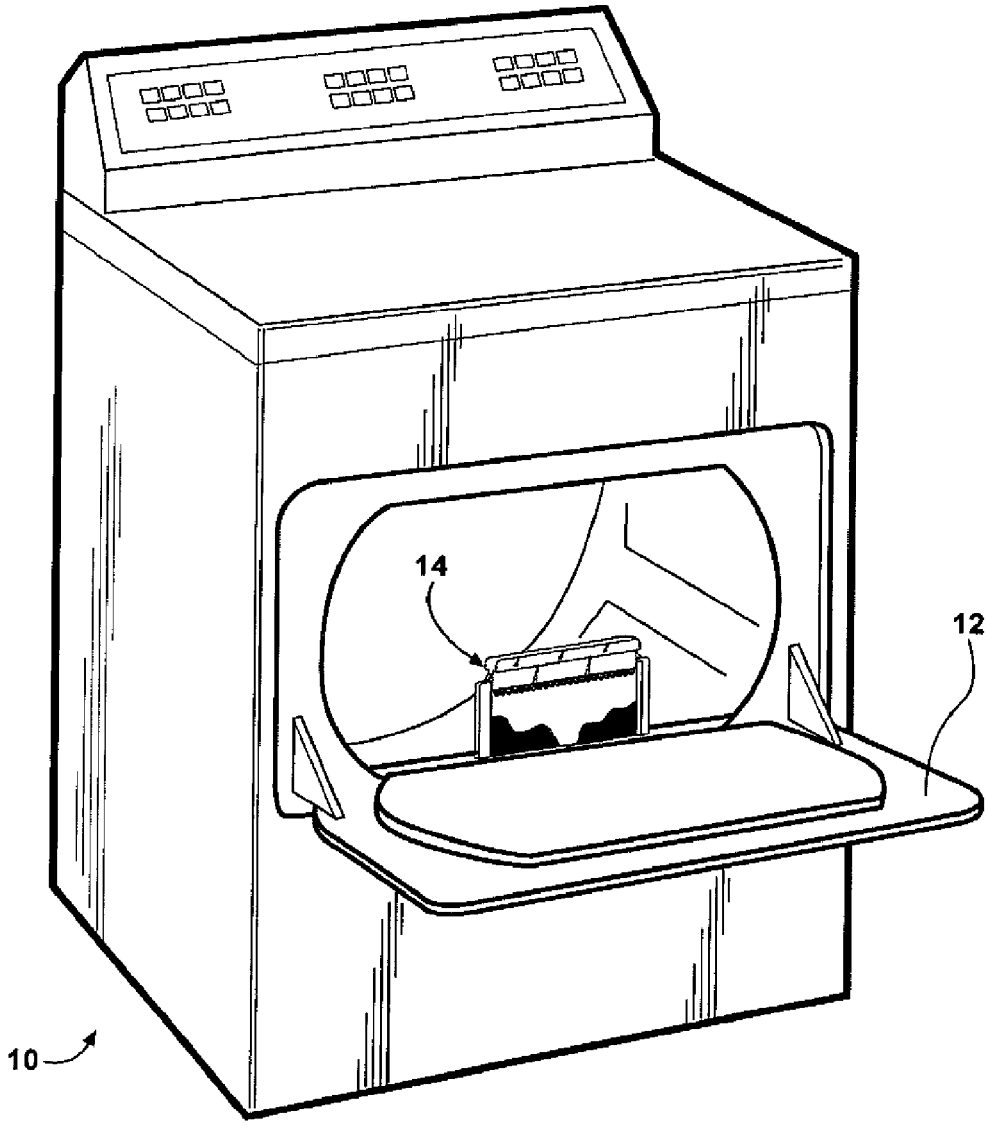
FIG. 1 is a pictorial view of the clothes dryer with the door open and a lint screen assembly according to an embodiment of the invention partially withdrawn.

Referring to the drawings and particularly FIG. 1, a clothes dryer 10 is shown with the door 12 opened to reveal a lint screen assembly 14 partially withdrawn from a slot in the front wall of dryer 10. This is the conventional arrangement for mounting a lint screen assembly, which can also be located at other locations.

The lint screen assembly 14 includes a rectangular open frame 16 advantageously constructed of molded plastic.

A lint screen panel 18 is held in the central opening in the frame.

Figure 2:
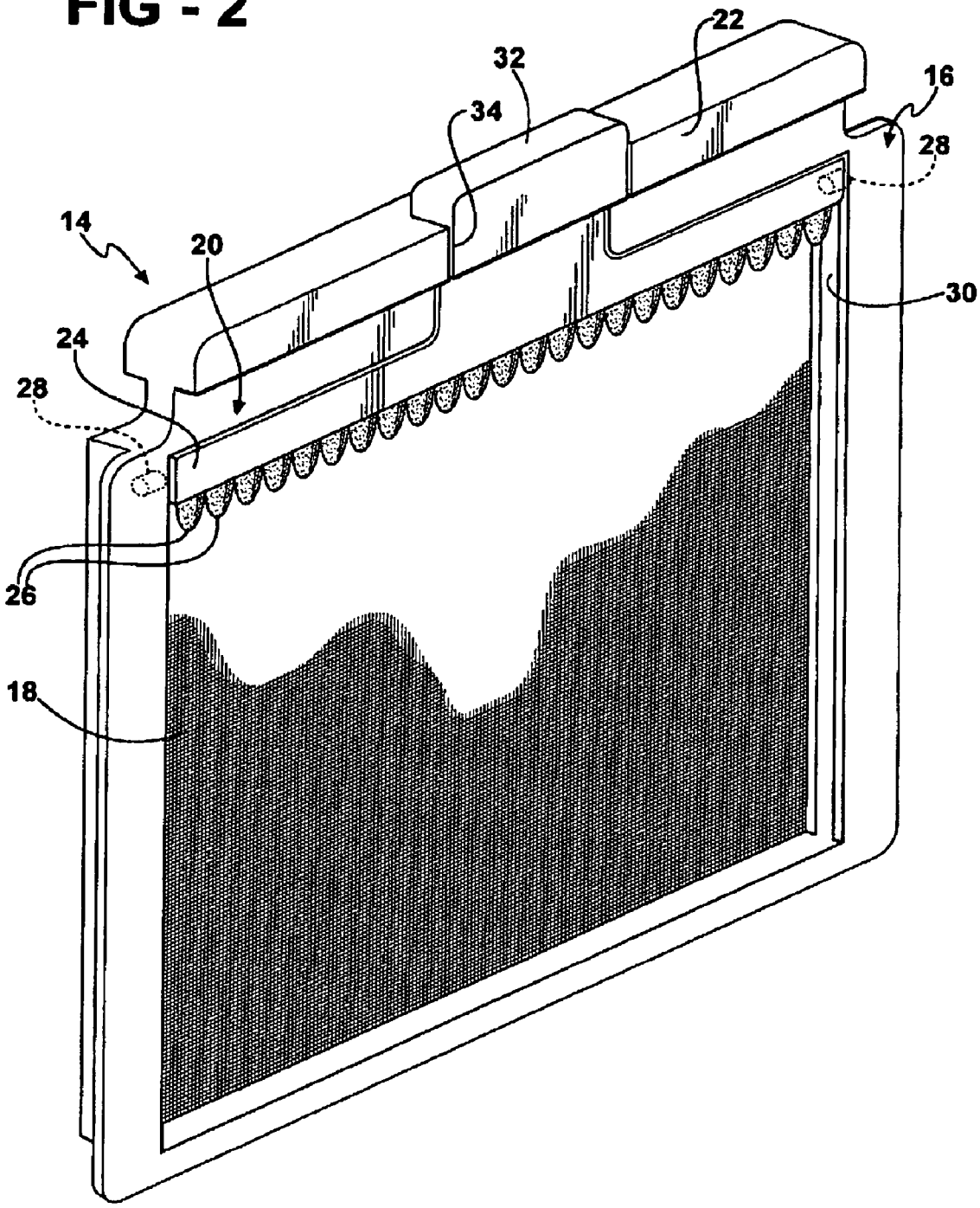
FIG. 2 is an enlarged pictorial view of the lint screen assembly shown in FIG. 1, with a scraper blade incorporated therein in the stowed position.
Figure 3:
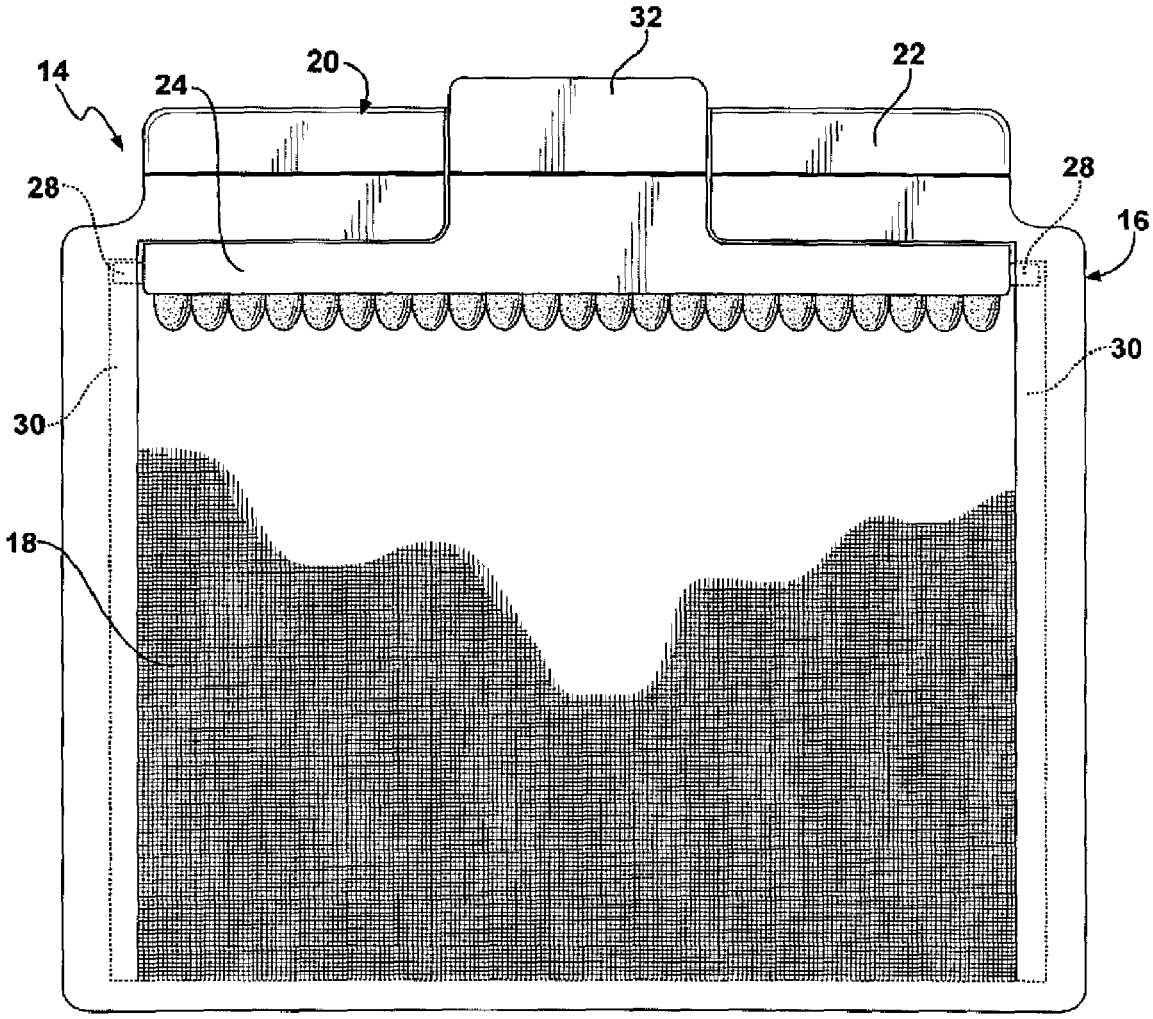
FIG. 3 is a front view of the lint screen assembly shown in FIG. 2.

An upper frame member 20 (FIG. 2) is formed with a hand grip 22 to make pulling the lint screen assembly 14 up out of the receiving slot easier.

An elongated scraper blade 24 is oriented to be flat to the screen panel 18. A series of rounded serrations 26 define a scraping edge which is directed downwardly in its stowed orientation.

The scraper 24 is pivotably mounted, by a pair of pivots 28 one projecting from each end thereof and received in a respective slot 30 formed in each side member of the frame 16 to be retained therein.

Figure 6:
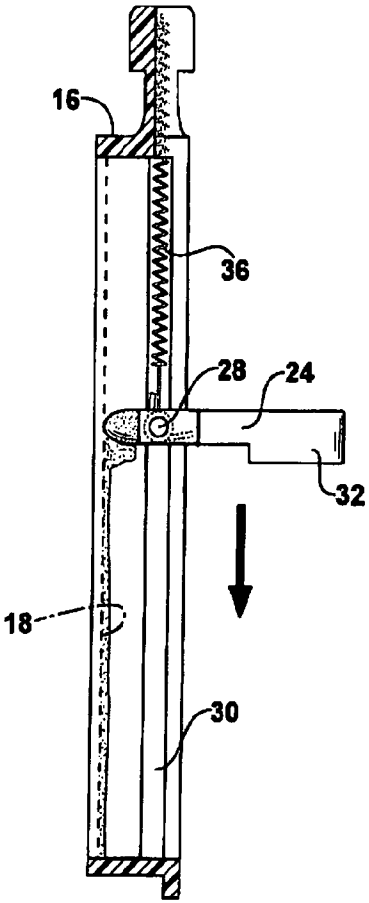
FIG. 6 is partially sectional side view of the lint screen assembly with the scraper blade partially stroked over the lint screen panel.
Figure 5:
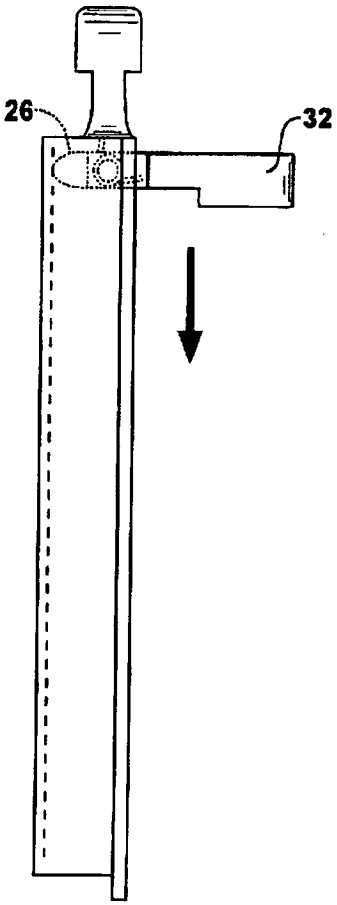
FIG. 5 is a side view of the lint screen assembly as shown in FIG. 4 with a scraper blade moved to a rotated position preparatory to executing a scraping stroke over the lint screen panel.

A lint screen handle 32 is received in a complementary recess 34 in the frame upper member 20 (FIG. 6), with the handle 32 projecting slightly above the frame upper member 20 which allows the handle 32 of the scraper blade 24 to be easily grasped to be pivoted down as seen in FIG. 5.

In this orientation, the serrated edge 26 is directed towards the lint screen panel 18.

The scraper blade 24 can then be stewed stroked downwardly, scraping lint from the surface of the lint screen panel 18.

Figure 7:
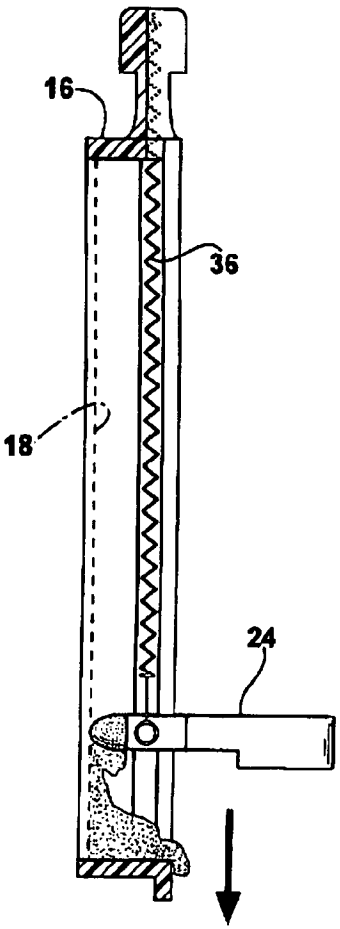
FIG. 7 is a partially sectional side elevational view of the lint screen assembly with the scraper blade approaching the end of the scraping stroke.

A first spring 36 is attached to each end of the blade 24, hooked around a respective pivot pin 28 to urge the scraper blade 24 to move up to the stowed position and stroking the scraper blade 24 down stretches the spring 36 as shown in FIG. 7.

A second spring 38 is attached to each of the pivots 28 of the screen blade 24 at one end and the frame 16 at the other end to urge the scraper blade 24 to the rotated up position.

Figure 4:
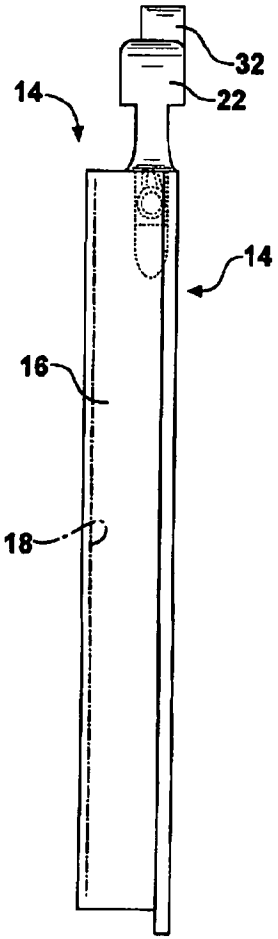
FIG. 4 is a side elevational view of the lint screen assembly shown in FIGS. 1-3.

The scraper blade 24 is thus spring urged to its stowed position shown in FIG. 4.

It can be appreciated that the chore of removing the lint from the lint screen panel 18 is rendered more convenient and neat and is carried out with a self stored scraper blade.

The invention claimed is:

1. A lint screen assembly for a clothes dryer comprising:

a generally rectangular open frame having pairs of side members defining an opening;

a lint screen panel mounted in said opening in said frame;

a scraper blade mounted to the frame extending across said open frame, between two of said side members, said scraper blade having opposite ends having portions engaged with side members to be held thereto while being slidable along said sides from a stowed, retracted position at the top of said frame so as to be able to be stroked across said lint screen panel with a scraping edge thereof positioned to engage any accumulated lint on the surface of said lint screen panel to remove the same, whereby a self stored scraper blade on said frame is provided.

2. The lint screen assembly according to claim 1 wherein said scraper blade is pivotally mounted to said open frame to be piovotable from a stowed position oriented to be flat against said lint screen panel to an on edge operative position with said edge directed at said lint screen panel so as to enable scraping accumulated lint from said lint screen panel when said scraper blade is stroked across said lint screen panel.

3. The lint screen assembly according to claim 1 wherein said scraper blade has one or more springs attached thereto and to said open frame resisting said stroking movement of said scraper blade and urging the scraper blade to said retracted stowed position on said frame.

4. The lint screen assembly according to claim 3 wherein one or more springs act on said scraper blade to resist said pivoting movement to said operative orientation and urge said scraper blade to pivot back to said stowed position.

5. The lint screen assembly according to claim 1 wherein said open frame has a pair of opposite side members between which said scraper frame slides when being stroked, said scraper blade having a pivot pin at each respective opposite end thereof comprising said end portions received in a slot in a respective frame side members to guide said stroking movement.

6. The lint screen assembly according to claim 5 wherein said pivot pin at each opposite end of said scraper blade allow pivoting of said scraper blade in said open frame from a stowed position with said scraper blade flat to said lint screen panel and an operative position with said scraping edge thereof directed towards said lint screen panel.

* * * * *

UNITED STATES PATENT AND TRADEMARK OFFICE

CERTIFICATE OF CORRECTION

PATENT NO. : 7,802,375 B2
APPLICATION NO. : 11/381759
DATED : September 28, 2010
INVENTOR(S) : Michael Johnson It is certified that error appears in the above-identified patent and that said Letters Patent is hereby corrected as shown below:

Col. 2, line 39, delete "stewed".

Signed and Sealed this
Eighth Day of March, 2011

David J. Kappos

David J. Kappos
*Director of the United States Patent and Trademark Office*